US008649695B2

(12) United States Patent
Banton

(10) Patent No.: US 8,649,695 B2
(45) Date of Patent: Feb. 11, 2014

(54) XEROGRAPHIC COLOR IMAGE FORMING MACHINE HAVING MARKING ENGINES WITH BOTH LOW GLOSS AND HIGH GLOSS DEVELOPERS

(75) Inventor: Martin Edward Banton, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 369 days.

(21) Appl. No.: 13/051,589

(22) Filed: Mar. 18, 2011

(65) Prior Publication Data

US 2012/0237235 A1 Sep. 20, 2012

(51) Int. Cl.
*G03G 15/01* (2006.01)

(52) U.S. Cl.
USPC ..... 399/54; 399/228

(58) Field of Classification Search
USPC ..... 399/54, 223, 228, 341
See application file for complete search history.

(56) References Cited

U.S. PATENT DOCUMENTS 5,160,969 A * 11/1992 Mizuma et al. ..... 399/223
5,285,246 A * 2/1994 Danzuka et al. ..... 430/45.1
5,613,176 A * 3/1997 Grace ..... 399/223
6,101,345 A 8/2000 Van Goethem et al.
7,630,669 B2 12/2009 Banton
7,734,225 B2 * 6/2010 Mashtare et al. ..... 399/223
7,791,751 B2 * 9/2010 Lofthus et al. ..... 358/1.15
8,298,741 B2 * 10/2012 Yoshida et al. ..... 430/123.52
2008/0240788 A1 10/2008 Mashtare et al.
2008/0291507 A1 * 11/2008 Rodrigues et al. ..... 358/474
2010/0239324 A1 * 9/2010 Winters et al. ..... 399/259
2011/0032573 A1 * 2/2011 Dalal et al. ..... 358/3.06

FOREIGN PATENT DOCUMENTS

JP 04204669 A * 7/1992
JP 2009037102 A * 2/2009

* cited by examiner

*Primary Examiner* — Robert Beatty
(74) *Attorney, Agent, or Firm* — Fay Sharpe LLP

(57) ABSTRACT

A color image forming machine is provided having a plurality of xerographic marking engines, each forming associated color separations that are combined to produce a color print image. Each marking engine includes two independently controlled developers using toners of the same color and strength of color but with different fused gloss characteristics, in that one of the toners will produce a print with a comparatively lower gloss and the other will produce a print with a comparatively higher gloss, thereby providing a greater control over the range of the gloss of the output print.

16 Claims, 2 Drawing Sheets

XEROGRAPHIC COLOR IMAGE FORMING MACHINE HAVING MARKING ENGINES WITH BOTH LOW GLOSS AND HIGH GLOSS DEVELOPERS

BACKGROUND

The disclosure relates to a xerographic printing machine, and more particularly, to an image forming machine having marking engines with a low gloss and a high gloss developer for the same color.

A typical electrophotographic, or xerographic, printing machine employs a photoreceptor, that is charged to a substantially uniform potential so as to sensitize the surface thereof. The charged portion of the photoreceptor is exposed to a light image of an original document being reproduced. Exposure of the charged photoreceptor selectively dissipates the charge thereon in the irradiated areas to record an electrostatic latent image on the photoreceptor corresponding to the image contained within the original document. The location of the electrical charge forming the latent image is usually optically controlled. More specifically, in a digital xerographic system, the formation of the latent image is controlled by a raster output scanning device, usually a laser or LED source.

After the electrostatic latent image is recorded on the photoreceptor, the latent image is developed by bringing a developer material into contact therewith. Generally, the electrostatic latent image is developed with dry developer material, referred to as toner, comprising toner particles which are attracted to the latent image, forming a visible powder image on the photoconductive surface. After the electrostatic latent image is developed with the toner particles, the toner powder image is transferred to a sheet, such as paper or other substrate sheets, using pressure and heat to fuse the toner image to the sheet to form a print.

Color prints are formed in this manner using one or more color separations. A different color toner, also referred to as a colorant, is applied and developed for each color separation and the color separations and then combined to form the resulting color print. A monochrome image is formed of one color separation, typically black. Process color images are typically constructed of separate cyan, magenta, yellow, and black (CMYK) separations. Extended colorant set images typically include the process-color colorant separations (CMYK) plus one or more additional colorant separations such as green, orange, violet, red, blue, white, varnish, light cyan, light magenta, gray, dark yellow, metallics, and so forth.

Toner has several fused characteristics which determine qualities of the resulting image print. The color a toner produces in a print is one characteristic. Another, is the gloss level of the fused toner in the print, also referred to as gloss. Toners typically produce a fairly consistent gloss level, with high gloss toners being used to produce glossy prints and low gloss toners being used to produce low gloss, or matte, prints.

It can be desirable to manipulate the gloss of printed images. In an xerographic system using a given print medium, the gloss level of a printed image for a given toner depends on fusing parameters, also referred to as set points. These set points can include the fusing time, which is the contact time spent between the fusing rollers, the fusing speed, the contact length which is the length of the nip defined by the pressure roller pair of the fixer, the fusing temperature, and the oil quantity applied to the outer circumference of the rollers. U.S. Pat. No. 6,101,345 to Van Goethem at al. teaches a method of varying the gloss level a particular toner can produce in a print by changing these fuser set points so that fusing at a high speed and at a lower fusing temperature results in a lower gloss, and fusing at low speed and at a higher temperature results in a higher gloss, for a specific print medium. However, this technique can be slow to respond and offers a rather limited range of gloss variation of a given toner.

Others have taught using more than one toner, each producing a different gloss level in the printed image. U.S. Pat. No. 7,630,669 to Banton, discusses using multiple black developer systems, each having black toner with different gloss characteristics, to produce low-cost-per page black and white prints. US Publication No. 2008/0240788 to Mashtare, et al. teaches using a xerographic tri-level process using a single charge and developments stations and two developers systems on a single PR drum wherein the second developer system can include the use of a clear toner with a gloss or matte finish. This toner does not have a color and serves as a coating which can change the gloss of the underlying text, picture or graphic.

It is, however, desirable for a xerographic image forming machine to provide greater control over the range of gloss levels available in the printed color image.

BRIEF DESCRIPTION

According to an exemplary embodiment of the invention, there is provided a color image forming machine including a plurality of marking engines generating associated color separations in a color toner image for producing a color print, each marking engine including: a photoreceptor drum, a first developer disposed adjacent the photoreceptor drum including a first toner having a predetermined first color and first color strength corresponding to the associated color separation, and first fused gloss characteristics, and a second developer disposed adjacent the photoreceptor drum including a second toner having the same predetermined first color and first color strength of the first toner and second fused gloss characteristics different than the first fused gloss characteristics.

According to an exemplary embodiment of the invention, there is provided a method of forming a color print in a xerographic image forming machine including: a controller forming color toner images on a separate photoreceptor for each of a plurality of different color separations, wherein for each different color separation the forming includes using one of a first developer and a second developer disposed adjacent the associated photoreceptor, the first developer having a toner of a first color and first color strength of the associated color separation, and first fused gloss characteristics of a relatively higher gloss, and the second developer having a toner of the first color and first color strength of the associated color separation, and second fused gloss characteristics of a relatively lower gloss lower than the relatively higher gloss; combining the color separations to form a multi-color composite toner image; transferring the multi-color composite toner image to a substrate; and fusing the multi-color composite toner image to the substrate to form a color print.

DETAILED DESCRIPTION

As used herein, the term "data" refers herein to physical signals that indicate or include information. An "image", as a pattern of physical light or a collection of data representing said physical light, may include characters, words, and text as well as other features such as graphics. A "digital image" is by extension an image represented by a collection of digital data. An image may be divided into "segments," each of which is itself an image. A segment of an image may be of any size up to and including the whole image. The term "image object" or "object" refers herein to identifiable structures within an image, such as a typographic character or symbol, photographic image, graphical object, or defined segment of an image.

In a digital image composed of data representing physical light, each element of data may be called a "pixel," which is common usage in the art and refers to a picture element. Each pixel has a location and value. Each pixel value is a bit in a "binary form" of an image, a gray scale value in a "gray scale form" of an image, or a set of color space coordinates in a "color coordinate form" of an image, the binary form, gray scale form, and color coordinate form each being a two-dimensional array defining an image. Although described herein as continuous tone processing, the present systems and methods apply equally as well to the processing of color images, wherein each separation is treated, effectively, as a gray scale or continuous tone image. Accordingly, references herein to the processing of continuous tone (contone) or gray scale images is intended to include the processing of color image separations as well. An operation performs "image processing" when it operates on an item of data that relates to part of an image.

Figure 1:
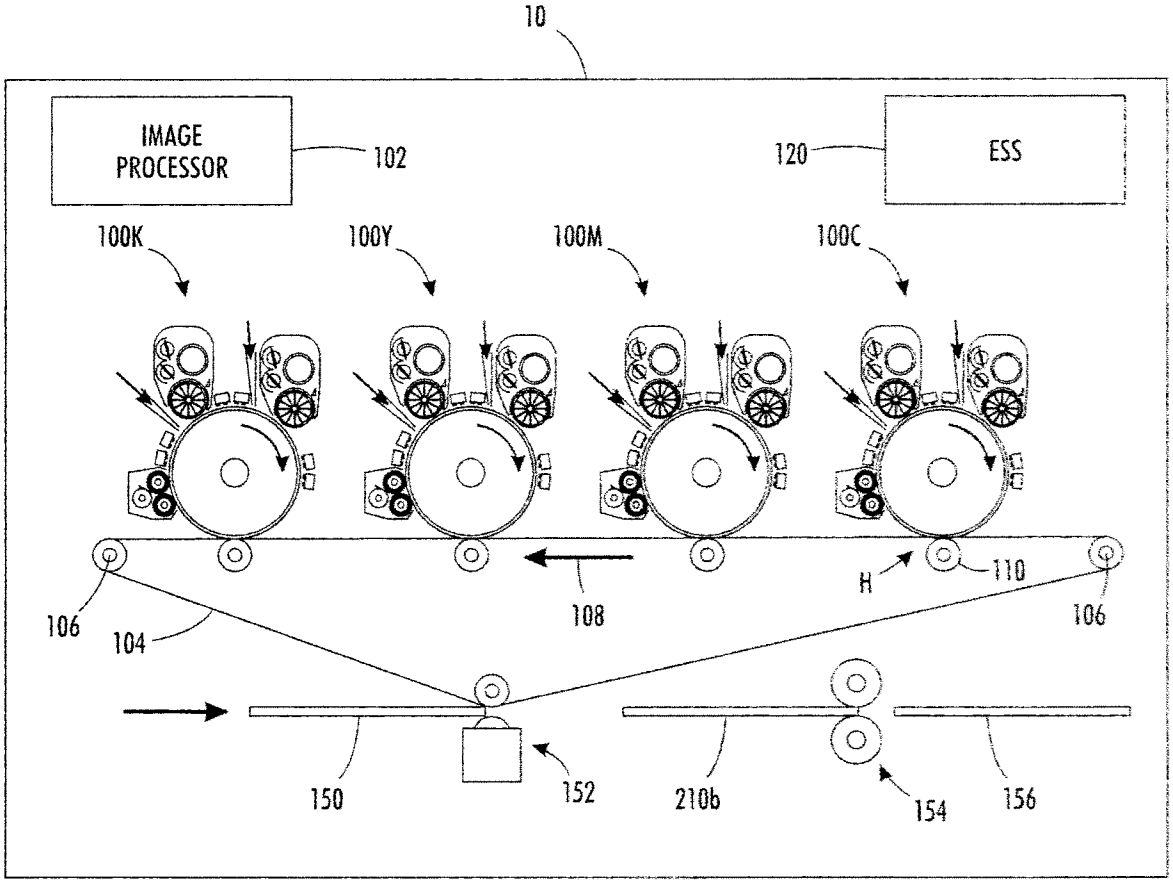
FIG. 1 illustrates a color image forming machine according to an exemplary embodiment of this disclosure.

Referring now to FIG. 1, a color image forming machine is shown generally at 10. The image forming machine 10, can be a xerographic or electrophotographic image forming device such as a multi-color digital printer, a digital color copy system, or the like. The image forming machine 10 includes a plurality of marking engines, referred to generally at 100, forming associated color separations that are combined to form a color print image, as described in further detail below.

In operation, a computer generated color digital image may be provided to image processor unit 102, or a color document (not shown) may be scanned to create the color digital image. The color digital image is a multi-bit digital signal representing the color density for each pixel (picture element) in the image to be produced as a print. The digital image is converted into bitmaps in a suitable color space in the image processor 102, or previously. For example, CMYK color images include bitmaps for yellow (Y), cyan (C), magenta (M), and black (K). The bitmap represents the color value for each pixel of the image. The digital image can include pixel tags to control which toner (high gloss or low gloss) is used to produce each of the associated printed pixels, as described in further detail below.

As illustrated in FIG. 1, the image forming machine 10 is a tandem architecture system including an intermediate transfer belt 104 entrained about a plurality of rollers 106 and adapted for movement in a process direction illustrated by arrow 108. Belt 104 is adapted to have transferred thereon a plurality of toner images, which are formed by the marking engines 100.

Each marking engine 100 forms an associated color separation by developing a single colorant toner image in succession on the belt 104 so that the combination of the color separations forms a multi-color composite toner image. While the color separations may be combined in different ways, they are each separately developed onto associated photoreceptors and then transferred to a compliant single-pass intermediate belt 104. When all of the desired color separations have been built up on the intermediate belt 104, the entire image is transfixed to substrate, such as paper, to form a print image, as described in further detail below.

Each marking engine 100 includes two development stations using toners of the same color and strength of color, also referred to as color strength, but with different fused gloss characteristics, such that one of the toners will produce a print with a comparatively lower gloss and the other toner will produce a print with a comparatively higher gloss. One or both of the toners can be used to form the associated color separation, as described in further detail below. Color strength is the facility with which a colored pigment maintains its characteristic color when mixed with another pigment. The higher the color strength, the less pigment is required to achieve a standard depth of shade.

For the purposes of example, the image forming machine 10 described herein is a CMYK marking system having four marking engines 100 which include: a cyan engine 100C forming a cyan color separation; a magenta engine 100M forming a magenta color separation; a yellow engine 100Y forming a yellow color separation; and a black engine 100K forming a black separation. However, it should be appreciated that a larger number of marking engines 100 can be used for generating Extended colorant set images which typically include these four process-color colorant separations (CMYK) plus one or more additional color separations such as green, orange, violet, red, blue, white, varnish, light cyan, light magenta, gray, dark yellow, metallics, and so forth. Each of the marking engines 100C, 100M, 100Y and 100K have similar structural characteristics except for the color of toners used and their associated gloss characteristics, and for the purposes of simplicity one engine shall be discussed in further detail.

Figure 2:
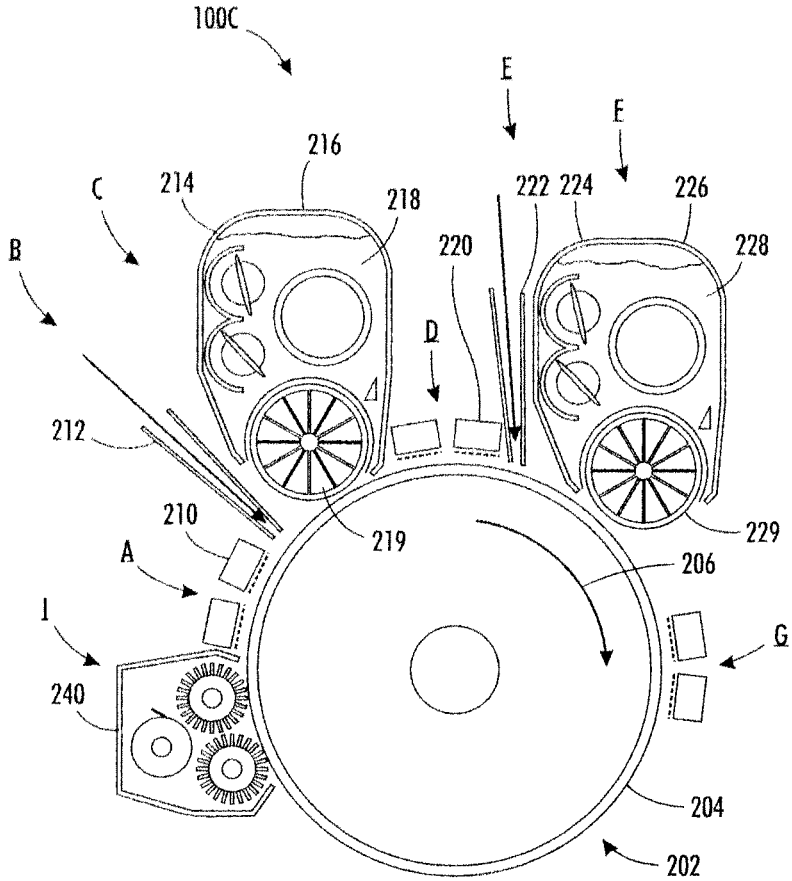
FIG. 2 illustrates an exemplary marking engine of the color image forming machine shown in FIG. 1.

Referring now to FIG. 2, the cyan marking engine 100C is shown in further detail. The engine 100C includes a charge retentive member in the form of a drum-shaped photoreceptor 202, having a continuous, radially outer charge retentive surface 204 constructed in accordance with well known manufacturing techniques. The photoreceptor 202 is supported for rotation such that its surface 204 moves in a process direction shown at 206 past a plurality of xerographic processing stations (A-I) in sequence, including first and second development stations C and F described below.

Initially, successive portions of the photoreceptor surface 204 pass through a first charging station A. At charging station A, a corona discharge device indicated generally at 210, charges portions of the photoreceptor surface 204 to a relatively high, substantially uniform potential during a charging operation.

Next, the charged portions of the photoreceptor surface 204 are advanced through a first exposure station B. At exposure station B, the uniformly charged photoreceptor charge retentive surface 204 is exposed to a scanning device 212 that causes the charge retentive surface to be discharged forming a latent image of the color separation of the corresponding engine, 100C in this example. The scanning device 212 can be a Raster Output Scanner (ROS), non-limiting examples of which can include a Vertical Cavity Surface Emitting Laser (VCSEL), an LED image bar, or other known scanning device. The ROS 212 is controlled by a controller 120 to discharge the charge retentive surface in accordance with a corresponding exposure pattern defined by the digital color image data to form at least a portion of the latent image of the color separation. A non-limiting example of the controller 120 can include an Electronic Subsystem (ESS) shown in FIG. 1, or one or more other physical control devices. The controller 120 may also control the synchronization of the belt movement with the engines 100C, 100M, 100Y and 100K so that toner images are accurately registered with respect to previously transferred images during transfer from the latter to the former.

The marking engine 100C also includes a first development station C disposed adjacent the first exposure station B (and immediately succeeding it in the process direction 206) for developing an image on the photoreceptor surface 204 corresponding to the exposure pattern provided to first exposure station B. The first development station C includes a developer 214 having a developer housing 216 holding a first toner 218. The first toner 218 is of a first color and color strength, such as cyan having a first color strength in the cyan marking engine 1000, magenta having a first color strength in the magenta engine 100M, yellow having a first color strength in the yellow marking engine 100Y, or black having a first color strength in the black marking engine 100K.

The first toner 218 has fused characteristics exhibiting a predetermined first gloss related to a quantity of light reflectance that can be measured with a gloss meter, for example a relatively higher gloss. The developer 214 includes a magnetic brush, roller, or other toner applicator, indicated generally at 219, advancing the first toner 218 into contact with the electrostatic latent images produced by the first exposure station B on the photoconductor 204 to form portions of the toner image for the associated color separation, as controlled by controller 120 in correspondence with the exposure pattern provided to the first exposure station. When referring to control and operation of the first development station C, it can be inferred that this refers to the control and operation of the first developer 214.

The marking engine 100C also includes a second charging station D having a corona discharge device indicated generally at 220. The second charging station D is similar to the first charging station A but it is controlled and operated independently of it by the controller 120 to charge portions of the photoreceptor surface 204 to a relatively high, substantially uniform potential during a charging operation associated with a second electrostatic latent image.

The marking engine 100C also includes a second exposure station E having a scanning device 222. The second exposure station E is similar to the first exposure station B but controlled and operated independently of it by controller 120 to cause the charge retentive surface 204 to be discharged in accordance with a corresponding exposure pattern defined by the digital image data to form at least a portion of a latent image of the color separation.

The marking engine 100C also includes a second development station F controlled independently of the first development station A by controller 120. The second development station F is disposed adjacent the second exposure station E (and immediately succeeding it in the process direction 206) for developing an image on the photoreceptor surface 204 corresponding to the exposure pattern provided to second exposure station. The second development station F includes a developer 224 having a developer housing 226 holding a second toner 228. As mentioned, the second toner 228 is of similar color and color strength as the first toner 218 but having different gloss characteristics, for example a relatively lower gloss, lower than the relatively higher gloss. In one non-limiting example, the lower gloss can be a matte gloss. The developer 224 includes a magnetic brush, roller, or other toner applicator, indicated generally at 229, advancing the second toner 228 into contact with the electrostatic latent images produced by the second exposure station E on the photoconductor 204 to form portions of the toner image for the associated color separation, as controlled by controller 120 in correspondence with the exposure pattern provided to the second exposure station. When referring to control and operation of the second development station F, it can be inferred that this refers to the control and operation of the second developer 224.

The second charging station D, second exposure station E and associated second development station F are disposed adjacent the photoreceptor surface 204 such that successive portions of the surface pass through them after the first charging station A, exposure station B and development station C. In this manner, the second charging station D, exposure station E and associated development station F can be activated to develop a toner image on the photoreceptor surface 204 using toner having different gloss characteristics than the first development station C, as described in further detail below.

A pretransfer dicorotron member at the pretransfer station G is provided to condition the toner for effective transfer using positive corona discharge.

Referring again to FIG. 1, at a transfer station H, an electrically biased roll 110 contacting the backside of the intermediate belt 106 serves to effect combined electrostatic and pressure transfer of toner images from the photoreceptor of engine 100C to the transfer belt 106. The roll 110 is biased to a suitable magnitude and polarity so as to electrostatically attract the toner particles from the photoreceptor 202 to the transfer belt 104 to form the toner image of the associated color separation on the transfer belt.

After the toner images created using engine 100C are transferred from the photoreceptor 202, the residual toner particles carried by the non-image areas on the photoconductive surface are removed from it at cleaning station I, shown in FIG. 2. A cleaning housing 230 supports therewithin cleaning brushes 232 which remove the toner from the photoreceptor surface 204.

After all of the toner images have been transferred from the engines 100C, 100M, 100Y, 100K, the multi-color composite toner image is transferred to a substrate 150, such as plain paper, by passing through a conventional transfer device 152. The substrate 150 may then be directed to a fuser device 154 to fix the multi-color composite toner image to the substrate to form the color print 156.

For each marking engine 100, the controller 120 provides control of the first charging station A, the first exposure station B, and the first development station C (including the first developer 214), separately and independently from the second charging station D, exposure station E, and development station F (including the second developer 224) to provide improved control of the gloss level of the output print. In one example, it is contemplated that only one set of the two sets of charging stations, exposure stations and development stations (A, B, and C, or D, E, and F) is used to form the toner image on the associated photoreceptor 202 for the particular color separation forming the color image. That is, the colorant used to print a page is provided by only one of the developers 214 or 224 of the associated marking engine 100. Metadata in the digital image data, such as for example a page tag can be used by the controller 120 to determine which developer 214 or 224 is used to produce the toner image on the associated photoreceptor in correspondence with the exposure pattern provided to the corresponding charging station (B or E). In this manner, a print having a relatively higher gloss can be produced by using the developer 214 with the higher gloss toner 218, or a print having relatively lower gloss can be produced by using the developer 224 with the lower gloss toner 228. Multiple page print jobs can include color pages (i.e. prints), of high gloss intermixed with pages (i.e. prints) of lower gloss, even matte depending on the low gloss toner used.

The controller 120 can adjust the fusing set points as taught by U.S. Pat. No. 6,101,345 to Van Goethem at al. incorporated by reference above, to provide further control of the gloss level of each page of the print image for the particular toner used. In one example, the fuser 154 can operate at the same set points for both toners. In another example, the controller 120 modifies the fuser set points differently for each page to provide further control of the gloss of the output print.

In yet another example, both developers 214 and 224 are used to form a single toner image on the photoreceptor. The controller 120 controls the use of both sets of charging stations, exposure stations and development stations (A, B, and C, and D, E, and F) to form the toner image on the associated photoreceptor 202, thereby using high gloss developer 214 to develop portions of the toner image corresponding to the exposure pattern provided to the first exposure station B, and using the low gloss developer 224 to develop portions of the toner image corresponding to the exposure pattern provided to the second exposure station E to produce one or more of the color separations for a print on a page. In this example, the second development station F (including the second developer 224) used in succession for the corresponding color separation can be scavengeless to avoid interaction of toners. The fuser 154 can operate at the same set points for both toners to produce a print image having improved gloss control.

Metadata in the form of a pixel tag associated with each pixel can be included in the digital image data to control which developer, one (214) having a higher gloss toner 218 or one (224) having a lower gloss toner 228, is used to form each pixel of the toner image on the photoreceptor for each color separation. These pixel tags can be referred to as gloss level pixel tags. The gloss level pixel tags can be generated by the image processor 102 in real time during image processing and associated with each pixel of each color separation in the digital image data. Alternatively, the gloss level pixel tags can be preselected prior to the image processor 102, such as upstream of the image processing and provided to the image processor or directly to the controller for inclusion in the digital image data.

The controller 120 uses the gloss level pixel tags as provided in the color image data to at least in part define the exposure pattern that is used to control the operation of the appropriate charging station (A or D), exposure station (B or E) and development station (C or F, including its developer 214 or 224, respectively) to form each pixel of the toner image on the photoreceptor of the associated color separation as described above. During such printing, both development stations would be "on", with each development station contributing to specific pixels as defined by the corresponding exposure patterns provided to the respective exposure stations. For example, when printing a page with a graphic image that is to have high gloss on an otherwise low gloss image, the exposure pattern sent to the exposure station (e.g. exposure station B) that immediately precedes the high gloss development station (e.g. development station C having developer 214 with the high gloss toner 218) would be activated to produce that part of the image, while the other exposure station (e.g. exposure station E) would be inactive by sending pixel tag information that tells this other exposure station to not provide any exposure to that part, the high gloss part, of the image.

The use of two toners 218, 228, each having different gloss characteristics for each color separation can enable some degree of "dial-a-gloss" as it will be easier to achieve a desired gloss over a smaller range for each of the two different toners than it would be to dial in a desired gloss over a larger range with only one toner, as done conventionally, by relying solely on changes in set points of the fuser and possibly other subsystems It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A color image forming machine including a plurality of marking engines generating associated color separations in a color toner image for producing a color print, each marking engine comprising:

a photoreceptor drum;

a first developer disposed adjacent the photoreceptor drum including a first toner having a predetermined first color and first color strength corresponding to the associated color separation, and first fused gloss characteristics;

a second developer disposed adjacent the photoreceptor drum including a second toner having the same predetermined first color and first color strength of the first toner and second fused gloss characteristics different than the first fused gloss characteristics; and a controller providing independent control of the first developer and second developer for each marking engine using tags to control of the gloss of the color print.

2. The color image forming machine of claim 1 wherein the controller activates only one of the first developer and the second developer for each marking engine to form the associated color separations.

3. The color image forming machine of claim 1 wherein the controller activates both the first developer and the second developer of at least one marking engine to form an associated color separation.

4. The color image forming machine of claim 1 wherein the controller uses page tags to provide independent control of the first developer and second developer for each marking engine.

5. The color image forming machine of claim 1 wherein the controller uses pixel tags to provide independent control of the first developer and second developer for each marking engine.

6. A xerographic color image forming machine comprising:

a first marking engine generating a first color separation toner image including:

a first photoreceptor drum, a first developer disposed adjacent the first photoreceptor drum including a first toner having a predetermined first color, first color strength, and first fused gloss characteristics, and a second developer disposed adjacent the first photoreceptor drum including a second toner having the same predetermined first color and first color strength of the first toner and second fused gloss characteristics different than the first fused gloss characteristics;

a second marking engine generating a second color separation toner image including:

a second photoreceptor drum, a third developer disposed adjacent the second photoreceptor drum including a third toner having a predetermined second color, second color strength, and third fused gloss characteristics, and a forth developer disposed adjacent the second photoreceptor drum including a forth toner having the same predetermined second color and second color strength of the third toner and forth fused gloss characteristics different than the third fused gloss characteristics a controller using tags for providing independent control of the first developer, second developer, third developer and fourth developer for developing toner images having predetermined fused gloss characteristics;

an intermediate transfer belt receiving the first and second color separation toner images in a multi-color composite toner image;

a transfer station transferring the multi-color composite toner image to a substrate; and a fuser fixing the multi-color composite toner image to the substrate to form a color print.

7. The xerographic color image forming machine of claim 6 further comprising a controller varying fuser set points to change the gloss of the color print.

8. The xerographic color image forming machine of claim 6 wherein the controller activates only one of the first developer and the second developer to form a first color separation and only one of the third developer and the fourth developer to form a second color separation.

9. The xerographic color image forming machine of claim 6 wherein the controller uses page tags to activate only one of the first developer and the second developer to form a first color separation and only one of the third developer and the fourth developer to form a second color separation.

10. The xerographic color image forming machine of claim 6 wherein the controller activates both of the first developer and the second developer to form a first color separation and both of the third developer and the fourth developer to form a second color separation.

11. A method of forming a color print in a xerographic image forming machine comprising:

under control of a controller, forming one or more color toner images on a separate photoreceptor for each of a plurality of different color separations using tags to control of the fused gloss characteristics of the one or more color toner images, wherein for each different color separation the forming includes using at least one of a first developer and a second developer disposed adjacent the associated photoreceptor, the first developer having a toner of a first color and first color strength of the associated color separation, and first fused gloss characteristics of a relatively higher gloss, and the second developer having a toner of the first color and first color strength of the associated color separation, and second fused gloss characteristics of a relatively lower gloss lower than the relatively higher gloss;

combining the color separations to form a multi-color composite toner image;

transferring the multi-color composite toner image to a substrate; and fusing the multi-color composite toner image to the substrate to form a color print.

12. The method of claim 11 wherein the forming further comprises the controller using page tags for controlling which one of the first and second developer is used in forming the color toner images for each of the plurality of different color separations.

13. The method of claim 11 wherein the forming further comprises the controller using pixel tags for controlling which one of the first and second developer is used in forming the color toner images for each of the plurality of different color separations.

14. The method of claim 11 wherein for at least one of the different color separations the forming further comprises using both the first developer and the second developer.

15. The method of claim 14 wherein the forming further comprises the controller using pixel tags for controlling the first and second developers in the forming the color toner images of the associated color separation.

16. The method of claim 15 wherein the forming further comprises the controller using pixel tags for controlling the first developer to form color toner image pixels having fused gloss characteristics of a relatively higher gloss and for controlling the second developer to form color toner image pixels having fused gloss characteristics of a relatively lower gloss lower than the relatively higher gloss.

* * * * *